United States Patent [19]

Dolan et al.

[11] 4,327,044

[45] Apr. 27, 1982

[54] METHOD OF IMPROVING OUTER PORTION OF A TEXTILE FIBER PROCESSING COMPONENT

[75] Inventors: John J. Dolan, Blairgowrie, Scotland; Syd Roocroft, Bolton, England

[73] Assignee: Dayco Corporation, Dayton, Ohio

[21] Appl. No.: 200,169

[22] Filed: Oct. 24, 1980

[51] Int. Cl.[3] ..... B29C 25/00

[52] U.S. Cl. ..... 264/36; 19/244; 264/39; 264/83; 264/169; 264/340; 264/343; 425/168; 525/355

[58] Field of Search ..... 264/340, 343, 169, 36, 264/83, 39, 338; 425/168, 183; 525/355; 19/243, 244

[56] References Cited

U.S. PATENT DOCUMENTS

| | | | |
|---|---|---|---|
| 2,126,733 | 8/1938 | Catt | 264/340 |
| 2,450,408 | 10/1948 | Baymiller | 19/244 |
| 2,867,849 | 1/1959 | Drew et al. | 264/340 |
| 2,928,135 | 3/1960 | Smith | 264/338 |
| 2,991,515 | 7/1961 | Rockoff | 260/793 |
| 3,130,449 | 4/1964 | Demas et al. | 264/338 |
| 3,423,377 | 1/1969 | Tennenhouse | 525/355 |
| 3,555,138 | 1/1971 | Bryan, Jr. | 264/83 |

*Primary Examiner*—Jeffery R. Thurlow
*Attorney, Agent, or Firm*—Joseph V. Tassone

[57] ABSTRACT

A method of improving the outer portion of a rotatable textile fiber processing component is provided, the method comprising the steps of making the outer portion substantially of butadiene copolymer rubber, subjecting the outer portion to the action of a halogen to define the desired properties of minimum compression set for the outer portion and a working surface which has a comparatively low coefficient of friction, mounting the component on a rotatable support means of a textile processing equipment, then operating the equipment whereby the outer portion of the component is worked, and applying additional halogen on the outer portion with the component in a stationary position in its working environment in the equipment while supported on the rotatable support means therefor after the outer portion has been worn from the working thereof whereby the outer portion is rejuvenated so that further operation of the equipment can take place with the component again having the desired properties.

10 Claims, 3 Drawing Figures

METHOD OF IMPROVING OUTER PORTION OF A TEXTILE FIBER PROCESSING COMPONENT

BACKGROUND OF THE INVENTION

1. Field of the Invention

This invention relates to rotatable textile fiber processing components.

2. Prior Art Statement

The processing of natural and synthetic textile fibers is achieved with rotatable fiber processing components such as cots, drafting aprons, rub aprons, spinning rolls, roll covers, and the like. The outer portions of these components are generally made using polymeric materials which resist abrasive wear from the various fibers being processed and also resist the various oils employed in processing the fibers as well as oils and the like which are an inherent part of the fibers. Further, various efforts have been made heretofore to provide compositions which when used to make components are designed to improve the working surfaces thereof and an example of such an effort is presented in U.S. Pat. No. 2,991,515.

It is known in the art that there is a tendency for these processing components to assume distorted or flattened configurations when their associated machines are inoperative, e.g., weekends, whereby it is desirable to provide such components having minimum compression set characteristics. It is also known that in rotatable fiber processing components there is a tendency for fibers being processed to wrap around or "lap-up" during normal usage and it is believed that the lapping tendencies of such fibers are due to the frictional properties of the working surfaces of the fiber processing components together with other factors such as static electricity.

Various polymeric formulations have been proposed heretofore for making rotatable fiber processing components in an effort to solve the problem of compression set and anti-lapping using a single formulation or compound. However, polymeric compounds which have good resistance to lapping tend to have poor compression set characteristics while compounds with good compression set characteristics tend to have poor lapping characteristics. In general, a material with good lapping characteristics has a comparatively low coefficient of friction.

It has been proposed heretofore to provide a method of improving the outer portion of a rotatable textile fiber processing component to define the desired properties of minimum compression set for the outer portion and a comparatively low coefficient of friction. This previously proposed method basically comprises making the outer portion substantially of butadiene copolymer rubber and as is known in the art the molecules of butadiene rubber contain sites that are capable of being acted upon by halogens to change the properties of such rubber. As a step of this previously proposed method, the outer portion is subjected to the action of a halogen to define the above-mentioned desired properties.

However, the above-described method comprises subjecting the outer portion of a rotatable textile fiber processing component to the action of a halogen with the component disassembled from its machine or prior to assembly thereon and involves a plurality of method steps including disposing the outer portion in a liquid bath containing a halogen, washing such outer portion in a suitable solution, and drying and curing the outer portion employing suitable drying means. As is apparent, this known method is time consuming and thus comparatively expensive. In addition, the mere fact that the method requires processing of each component away from its associated machine and rotatable support means therefor is inherently more time consuming and expensive.

SUMMARY

It is a feature of this invention to provide a method of improving the outer portion of a rotatable textile fiber processing component to define the desired properties of minimum compression set for the outer portion and a working surface which has a comparatively low coefficient of friction and wherein such method is achieved simply and economically.

Another feature of this invention is to provide a method of the character mentioned comprising the steps of making the outer portion substantially of butadiene copolymer rubber, subjecting such outer portion to the action of a halogen to define the above-mentioned desired properties, mounting the component on a rotatable support means of a textile processing equipment, then operating the equipment whereby the outer portion of the component is worked, and applying additional halogen on the outer portion with the component in a stationary position in its working environment in the equipment while supported on the rotatable support means therefor after the outer portion has been worn from the working thereof whereby the outer portion is rejuvenated so that further operation of the equipment can take place with the component again having the desired properties thereby eliminating the need to process the fiber processing component apart from its associated machine.

Another feature of this invention is to provide a method of the character mentioned particularly applicable to a rotatable textile fiber processing component having the outer portion thereof made of butadiene-acrylonitrile copolymer rubber.

Another feature of this invention is to provide a method of the character mentioned comprising the further steps of drying and curing the outer portion of the fiber processing component with ambient air while maintaining such component on its textile machine with the outer portion thereof stationary on its rotatable support means.

Another feature of this invention is to provide a method of the character mentioned wherein the step of applying a halogen results in such halogen permeating a thickness of the outer portion and entering sites in the butadiene molecules that are capable of being acted upon whereby the halogen chemically acts on the butadiene and changes the original properties of the outer portion to define the above-described desired properties.

Another feature of this invention is to provide a method of the character mentioned wherein the step of applying the halogen may consist of spraying, brush coating, or wiping a liquid containing a halogen on such outer portion.

Another feature of this invention is to provide a method of the character mentioned wherein the step of applying the halogen by spraying may be achieved by a comparatively inexperienced operator utilizing a simple aerosal type spray container containing a halogen.

Therefore, it is an object of this invention to provide a method of improving the outer portion of a rotatable textile fiber processing component having one or more of the novel features set forth above or hereinafter shown or described.

Other details, features, uses, objects, and advantages of this invention will become apparent from the embodiments thereof presented in the following specification, claims, and drawings.

BRIEF DESCRIPTION OF THE DRAWING

The accompanying drawing shows a present preferred embodiment of this invention, in which.

DETAILED DESCRIPTION

Figure 1:
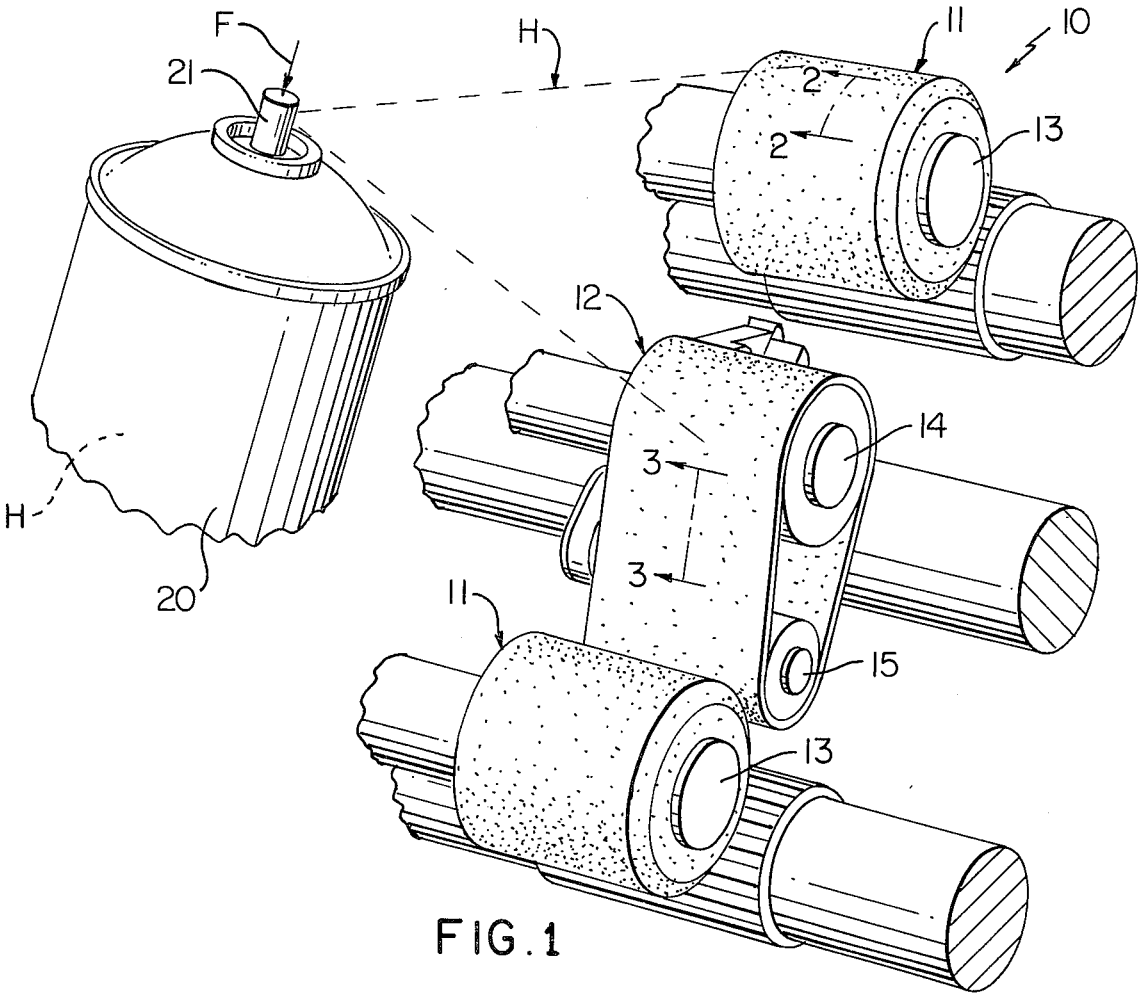
FIG. 1 is a perspective view with parts in cross section and parts broken away particularly illustrating one example of the method of this invention.

Reference is now made to FIG. 1 of the drawing which illustrates one exemplary embodiment of the method of this invention being carried out with rotatable textile fiber processing components in situ on a textile fiber processing machine 10 wherein only a fragmentary portion of such machine 10 is illustrated. The components on which the method is carried out comprise a pair of cots each designated by the same reference numeral 11 and a drafting apron 12.

Each cot 11 is supported on rotatable support means therefor shown as a rotatable shaft 13; and, the apron 12 is supported on rotatable support means in the form of a rotatable shaft 14 and an idler shaft 15. The shafts 13 and 14 are adapted to be suitably rotated, as is known in the art, in a cooperating manner and with other components of the machine 10 to enable the processing of textile fibers (not shown) which may be either natural or synthetic fibers. Because the overall machine 10 and the above-mentioned other components do not comprise this invention, a further detailed description thereof will not be presented herein.

Figure 2:
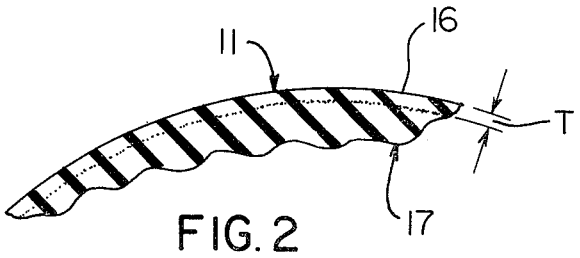
FIG. 2 is a greatly enlarged fragmentary cross sectional view taken essentially on the line 2—2 of FIG. 1 and high-lighting that the outer portion of a rotatable fiber processing component in the form of a cot has been improved utilizing the method of FIG. 1.
Figure 3:
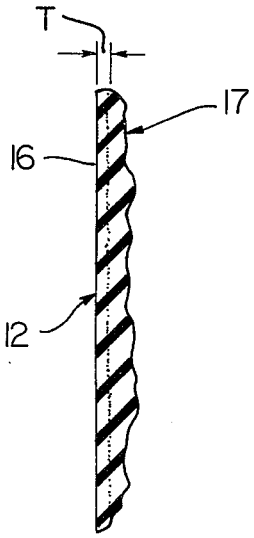
FIG. 3 is a view similar to FIG. 2 and taken essentially on the line 3—3 of FIG. 1 to highlight that the outer portion of a fiber processing component in the form of a drafting apron has also been improved utilizing the method of FIG. 1.

The fiber processing components, shown as cots 11 and apron 12, in this example of the invention, have outer portions 16 (FIGS. 2 and 3) made substantially of butadiene copolymer rubber and such rubber is designated generally by the reference numeral 17 and suitably cross-hatched to indicate rubber. As indicated in the prior art statement of this application, it is known to make the outer portion of a rotatable textile fiber processing component substantially of butadiene-copolymer rubber and subject such outer portion to the action of a halogen. However, the above-described method is comparatively complex in that it requires a plurality of steps with the component removed from its rotatable support means and machine whereby such method is comparatively more expensive and results in unnecessary delays in the use of textile fiber processing equipment. In addition, it is very difficult to remove a textile fiber processing component from its machine without substantial damage thereto whereby as a practical matter, it is not feasible to rejuvenate the outer portion of such component using the previously described method.

In accordance with the teachings of this invention, the outer portion 16 of each component 11 and 12 is subjected to the action of a halogen by the step of applying the halogen (indicated by the letter H in a spray pattern in FIG. 1) on the outer portion with each component 11 and 12 in a stationary position in its working environment and while supported on rotatable support means therefor. In particular, with each cot 11 installed on its rotatable support shaft 13 and with the apron 12 installed on its rotatable shaft 14 and idler shaft 15, the halogen H is applied on the outer portion 16 of each component.

In this example of the invention, the halogen H comprises a liquid which is dispensed in a known manner from an aerosol type container 20 by applying a force F on a dispensing valve 21 of such container causing such halogen to be dispensed as a spray on the outer portion of the cots 11 and apron 12. The halogen H permeates the outer portion 16 of the butadiene-acrylonitrile copolymer rubber 17 by a thickness T in each component 11 and 12. The actual magnitude of this thickness T varies as a function of many parameters, including amount of butadiene in the composition, amount of halogen H applied per unit of area, and the like. However, such thickness is generally of the order of microns. Once the halogen H permeates the thickness T of the outer portion 16, such outer portion is allowed to dry and cure in normal ambient air and with each component stationary on its rotatable support.

The outer portion 16 of each component 11 and 12 acted upon or activated by the halogen H improves the properties of such outer portion defining the desired properties therein of minimum compression set therefor and defines a working surface which has a comparatively low coefficient of friction. This dual result is achieved with optimum simplicity and does not require special handling of the components 11 and 12.

It will also be appreciated that with normal use of the components 11 and 12, there is a tendency for wear of the outer portion through the thickness T. Once this wear occurs, it will be readily apparent by merely observing the operation of the overall machine to determine the tendency of the fibers being processed to lap and also observing the tendency of the outer portions 16 of the components 11 and 12 to assume a compression set, either overnight or over weekends when the equipment is normally inoperative. When this occurs, it is a simple matter to effectively rejuvinate such outer portions by again spraying the outer portion of the worn components 11 and 12 and allowing drying and curing thereof in ambient air and in situ as previously described. It should be emphasized that after spraying the halogen on the outer portion of the components 11 and 12, such components are allowed to set and cure in ambient air without requiring washing or special drying techniques whereby the method of this invention is achieved with optimum simplicity.

In the above description, the outer portion of each component 11 and 12 has been subjected to the action of a halogen by applying the halogen on such outer portion by spraying. However, it is to be understood that the applying step may comprise brushing, wiping, or other suitable means of applying a liquid containing the halogen on the outer portion. In the case of wiping, the wiping action may be achieved utilizing any suitable device such as a cloth, sponge, or the like.

The method of this invention has been described in connection with components 11 and 12 having outer portions 16 made substantially of a butadiene copolymer rubber; and, such method is most effective in connection with textile fiber processing components wherein the outer portions 17 thereof are comprised of butadiene-acrylonitrile copolymer rubber. It will also be appreciated that the overall construction of the components may be such that they are provided with suitable reinforcing means, inner layers, and the like, as is known in the art. However, regardless of the construction of such components, the method of this invention is directed to improving the outer portion of each fiber processing component to define the desired properties of minimum compression set for the outer portion and the provision of a working surface which has a comparatively small coefficient of friction.

In this disclosure of the invention, reference has been made throughout to the utilization of a halogen for the purpose of improving the outer portion of a rotatable fiber processing component of the character described. The preferred halogen is chlorine in the case of components made by butadiene-acrylonitrile copolymer rubber; however, it is to be understood that any halogen may be utilized.

Reference has also been made herein to the face that the outer portion of each fiber processing component is made substantially of butadiene copolymer rubber. This reference to substantially is intended to cover situations in which the butadiene in such outer portion constitutes at least 20%, by weight, of the compound defining the outer portion.

While present exemplary embodiments of the method of this invention have been illustrated and described, it will be recognized that the method of this invention may be otherwise variously embodied and practiced within the scope of the following claims.

What is claimed is:

1. In a method of improving the outer portion of a rotatable textile fiber processing component to define the desired properties of minimum compression set for said outer portion and a working surface which has a comparatively low coefficient of friction, said method comprising the steps of, making said outer portion substantially of butadiene copolymer rubber, subjecting said outer portion to the action of a halogen to define said desired properties, mounting said component on a rotatable support means of a textile processing equipment, and then operating said equipment whereby said outer portion of said component is worked, the improvement comprising the step of applying additional halogen on said outer portion with said component in a stationary position in its working environment in said equipment while supported on said rotatable support means therefor after said outer portion has been worn from said working thereof whereby said outer portion is rejuvenated so that further operation of said equipment can take place with said component again having said desired properties.

2. A method as set forth in claim 1 in which said step of making said outer portion comprises making said outer portion comprised primarily of said butadiene copolymer in the form of butadiene-acrylonitrile copolymer rubber.

3. A method as set forth in claim 1 in which said making step comprises making said outer portion containing said butadiene copolymer in the amount of at least 20% by weight of the composition defining said outer portion.

4. A method as set forth in claim 2 and comprising the further steps, after said step of applying, of drying and curing said outer portion with ambient air while maintaining the component and said outer portion thereof stationary on its rotatable support means.

5. A method as set forth in claim 2 in which said applying step comprises applying chlorine.

6. A method as set forth in claim 5 in which said applying step comprises applying chlorine such that it permeates said outer portion by a thickness generally of the order of microns.

7. A method as set forth in claim 2 in which said applying step comprises spraying said outer portion with a liquid containing said halogen.

8. A method as set forth in claim 2 in which said applying step comprises brush coating said outer portion with a liquid containing said halogen.

9. A method as set forth in claim 2 in which said applying step comprises wiping said outer portion with a liquid containing said halogen.

10. A method as set forth in claim 4 in which said drying and curing steps are achieved in said ambient air for a time period generally of the order of one hour.

* * * * *